United States Patent [19]

Shultz

[11] Patent Number: 4,837,954

[45] Date of Patent: Jun. 13, 1989

[54] TRANSPARENT PICTURE FRAME CONSTRUCTION

[75] Inventor: Julius Shultz, North White Plains, N.Y.

[73] Assignee: Dax Manufacturers Inc., Yonkers, N.Y.

[21] Appl. No.: 88,056

[22] Filed: Aug. 21, 1987

[51] Int. Cl.[4] ..... A47G 1/06; G09F 1/12

[52] U.S. Cl. ..... 40/152; 40/661

[58] Field of Search ..... 40/152, 152.1, 124, 40/16, 16.2, 16.4, 603, 12, 11 R, 156, 661

[56] References Cited

U.S. PATENT DOCUMENTS

| | | | |
|---|---|---|---|
| 1,200,229 | 10/1916 | Philips | 40/12 |
| 2,337,517 | 12/1943 | Wotton | 40/12 |
| 2,363,186 | 11/1944 | King | 40/12 |
| 3,694,947 | 10/1972 | Mukai et al. | 40/152 |
| 3,723,904 | 3/1973 | Bernier | 40/152 |
| 4,270,286 | 6/1981 | Sulzer | 40/156 |
| 4,442,617 | 4/1984 | Frye et al. | 40/10 D |

FOREIGN PATENT DOCUMENTS

| | | | |
|---|---|---|---|
| 2172734 | 9/1986 | United Kingdom | 40/530 |

*Primary Examiner*—Robert Peshock
*Assistant Examiner*—Michael Lynch
*Attorney, Agent, or Firm*—Schweitzer & Cornman

[57] ABSTRACT

A picture frame comprising a generally rectangular main frame plate having a rectangular flat transparent front face; side edge walls extending inwardly and rearwardly from the long sides of said front face at a predetermined acute angle; a plurality of clamping members adapted to firmly engage the inner surfaces of said side edge walls and the inner surface of said front face; each of said clamping members comprising an elongated bar having a resilient spring finger means at each end thereof; said spring finger means being of sufficient resilience to apply a strong clamping force through said elongated bar toward said front face independently of the spacing of said bar from said face; whereby sheet material to be displayed, regardless of its thickness, will be clamped securely and firmly against said face by said clamping members.

4 Claims, 1 Drawing Sheet

TRANSPARENT PICTURE FRAME CONSTRUCTION

BACKGROUND OF THE INVENTION

The present invention is directed to an improvement in transparent picture frames of the type having a planar front face with longitudinal side edges bent at an angle to said front face and having open ends. Prior frames of this general type have been disclosed in U.S. Pat. Nos. 3,694,947 and 4,270,288. Specifically the present invention is directed to an improvement in the means for retaining artwork within such a frame, as well as for hanging such a frame from its open end.

SUMMARY OF THE INVENTION

The picture frame of the present invention has two fundamental elements, a one-piece frame plate formed of a transparent thermoplastic sheet material having its longitudinal side edges bent back at an angle to the plane of the front face and a series of special clamping members which cooperate with the bent edges to hold artwork against the front face of the faceplate for viewing. The clamping members are formed from an extruded elongated channel bar member having a unique cross-section enhancing the rigidity and strength of the membrane while minimizing its weight. Each of the ends of the elongated extruded clamping bar member is closed off by specially formed resilient spring finger means which is generally similar in angular shape to the angle of the bent-back side edges of the frame plate. The spring finger means are sufficiently resilient to enable the retaining bar members to be engaged firmly across the width of the frame plate through frictional engagement of said finger means with the bent edges of the plate. A series of the clamping bar members, as will be understood, hold the artwork to be framed against the face of the transparent frame.

From the accompanying drawings and the following detailed description of the invention, a more complete understanding and appreciation of the invention and its attendant advantages may be obtained.

DETAILED DESCRIPTION OF THE INVENTION

The new and improved transparent frame construction of the present invention generally includes a main frame plate 10 formed by appropriate plastic bending techniques from a flat sheet of transparent acrylic thermoplastic or the like having a clear, flat faceplate 11 from the longitudinal side edges which are rearwardly angled, bent retaining edges 12, 13 extending for the length of the frame. The edges 12, 13 are angled rearwardly from the flat faceplate 11 at an angle of approximately 75°.

Figure 4:
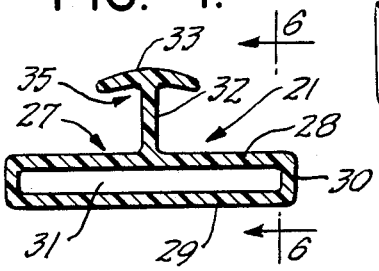
FIG. 4 is a cross-sectional view taken along line 4—4 of FIG. 1.
Figure 5:
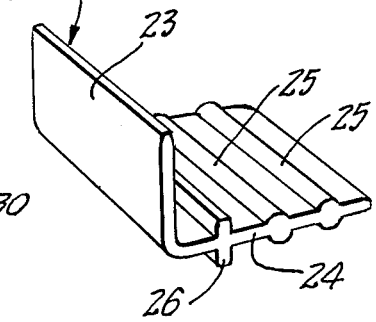
FIG. 5 is a perspective view of the resilient specially formed spring finger member of the present invention.

Associated with the main frame plate 10 are three or more clamping members 20, each of which is formed from an extruded, elongated hollow clamping bar 21, the opposite ends of which uniquely mount special spring finger member 22. The spring finger member 22 are themselves formed by extrusion and include a cantilevered, flexible resilient clamping leaf 23 supported from a base plate 24 having integral round ribs 25 and a stop 26 formed thereon (FIG. 5). As shown in FIG. 4, the clamping bar 21, which is also formed by a thermoplastic extrusion, has a hollow flange 27 having an upper wall 28, and a lower wall 29 interconnected by short end walls 30 to form a narrow cavity 31. The clamping bar 21 also has integral therewith a web 32 which supports a T-shaped head member 33, which in cooperation with the web 32 forms a track 35 from which the completed frame construction may be supported from nails or picture hooks on a wall, as will be understood.

Figure 6:
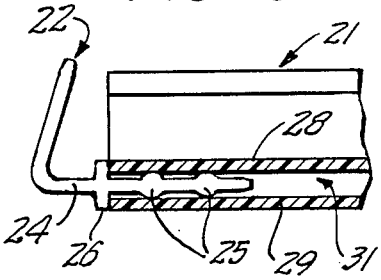
FIG. 6 is a fragmentary cross-sectional view showing the interrelationship of the spring finger member with the elongated clamping bar of the present invention.

The spring finger member 22 is inserted into the cavity 31 as shown in FIG. 6 by a force fit. The ribs 25 firmly engage the inner wall surfaces 28 and 29 to retain the spring finger member 22 firmly in place and to make a semi-permanent assembly. The stop element 26 abuts the end edge of the clamping bar 21 as shown.

Figure 7:
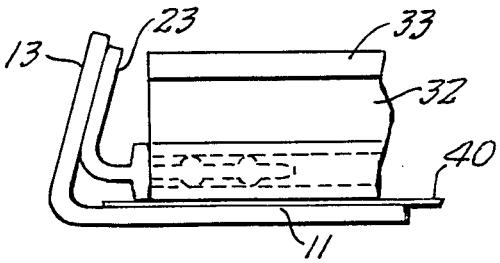
FIG. 7 is a cross-sectional view showing the cooperation of the resilient spring finger of the clamping member with the bent side edge of the main frame plate; and, FIG. 8 is a view similar to FIG. 7 in which a thicker piece of artwork is held against the frame plate by the clamping member in accordance with the principles of the invention.
Figure 8:
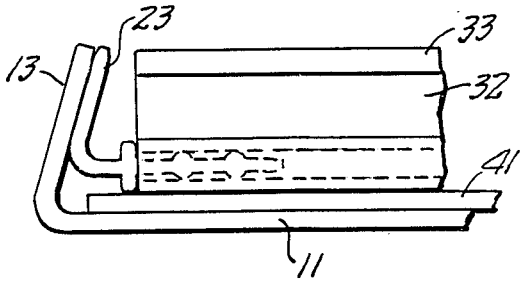

In accordance with the principles of the invention, the clamping bar 20 is adapted to hold any artwork, whether it is very thin, such as the artwork 40 shown in FIG. 7 or whether it is very thick, such as a board 41 as shown in FIG. 8 (or artwork, a mat, and/or a board of substantial thickness, not illustrated) against the faceplate 11. The resilient finger 23, which is angled upwardly from the baseplate 24 at an angle of 75° so as to be generally similar in shape to that of the angle formed between the side edges 12, 13 of the main frame plate and faceplate 11. The spring fingers 23 are sufficiently flexible so that when the clamping members 21 are inserted congruently within the main frame plate 10 as shown in FIG. 1, FIG. 7 and FIG. 8, they rigidly and securely clamp the artwork sandwiched between the clamping bars 20 and the faceplate 11 for safe display.

As will be understood and as an important aspect of the present invention, the clamping members 20 may be readily formed in any number of lengths, by extrusion and simple severing, to fit frames bent to any width. Thus, using two dies, one for the extrusion from which the finger members 22 are formed and one from which the elongated bars 21 are formed, a frame manufacturer will be able to readily make a complete line of frames in as many different sizes as desired with minimal capital investment.

Figure 1:
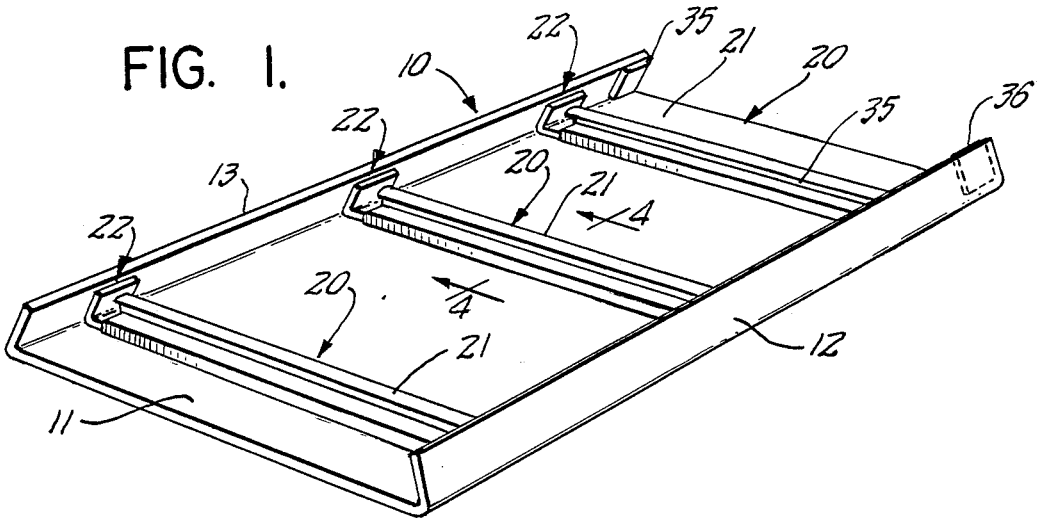
FIG. 1 is a perspective view of the new and improved transparent frame construction of the present invention.
Figure 2:
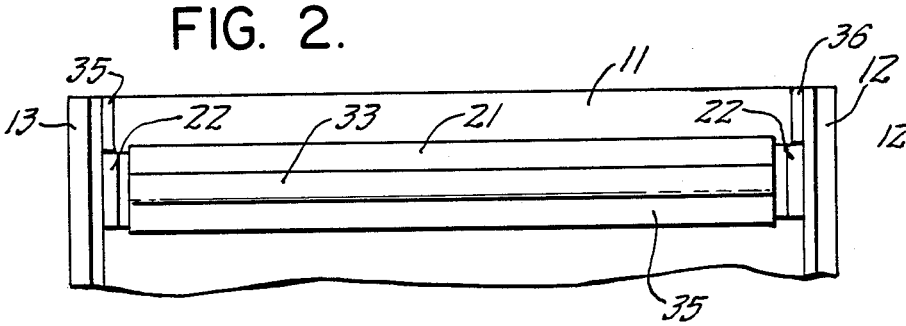
FIG. 2 is a fragmentary rear elevational view of the inventive frame construction.
Figure 3:
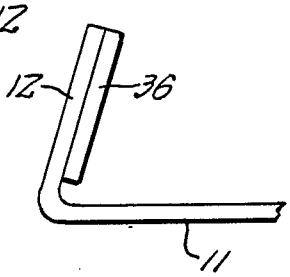
FIG. 3 is a fragmentary side elevational view of an upper end of the inventive frame construction.

The new frame construction of the present invention further includes stop members 35, 36 cemented to the ends of the edge walls 12, 13 as shown in Figs. 1 and 2. In accordance with the principles of the invention, the uppermost clamping bar 21 (when the frame is viewed with its upper end being a short side of the frame) is abutted against the stops 35, 36 as shown in FIG. 2. Thus, notwithstanding, that the main frame plate 10 is open at its short sides, it still may be hung from the unique track 35 formed by the head 33 and web 32 in a vertical position as will be understood. This is a marked improvement over frames of this type which heretofore could only be hung longitudinally by hooks engaging the side edge portions 12, 13 of such frames.

It will be appreciated by those skilled in the art that the foregoing disclosure is intended to be representative of the principles of the present invention and that various changes may be made therein without departing from the clear teachings of the disclosure. Accordingly, references should be made to the following appended claims for a determination of the full scope of the present invention.

I claim:

1. A transparent frame construction comprising (a) a generally rectangular thermoplastic main frame plate having a rectangular flat transparent front face;

(b) side edge walls extending inwardly and rearwardly from the long side of said front face at a predetermined acute angle, said walls having end edges;

(c) a plurality of rigid non-flexible rectilinear clamping members engage the inner surfaces of said front face;

(d) each of said non-flexible clamping members comprising a hollow extruded rigid longitudinal bar;

(e) said bars defining at their opposite free ends narrow cavities;

(f) resilient flexible spring finger means congruent in shape with said acute angles supported on friction plates;

(g) said friction plates force fitted into said narrow cavities;

(h) said flexible spring finger means being of sufficient resilience to apply a strong clamping force through said rigid elongated hollow bar toward said front face independently of the spacing of said bar from said face;

(i) whereby sheet material to be displayed, regardless of its thickness, will be clamped securely and firmly against said face by said clamping members.

2. The frame of claim 1, in which (a) said clamping members have hook forming means integrally formed along their lengths.

3. The frame of claim 1, in which (a) stop means are fixed to the inner surfaces of said side wall edges proximate to the ends thereof;

(b) the uppermost of said clamping members abuts said stop means;

(c) whereby said frame may be hung vertically from said clamping member.

4. The frame of claim 3, in which (a) said base member includes rib means adapted to enhance the force fit of said finger means with said hollow bars;

(b) a seating means is included in said finger means to facilitate and control said force fit.

* * * * *